US010858857B2

(12) United States Patent
Doelling

(10) Patent No.: US 10,858,857 B2
(45) Date of Patent: Dec. 8, 2020

(54) ANTI-CLIMBING DEVICE

(71) Applicant: Stefan Doelling, Drochtersen (DE)

(72) Inventor: Stefan Doelling, Drochtersen (DE)

( * ) Notice: Subject to any disclaimer, the term of this patent is extended or adjusted under 35 U.S.C. 154(b) by 453 days.

(21) Appl. No.: 15/737,795

(22) PCT Filed: Jun. 27, 2016

(86) PCT No.: PCT/DE2016/100287

§ 371 (c)(1),
(2) Date: Dec. 19, 2017

(87) PCT Pub. No.: WO2017/000934

PCT Pub. Date: Jan. 5, 2017

(65) Prior Publication Data

US 2019/0003201 A1 Jan. 3, 2019

(30) Foreign Application Priority Data

Jul. 1, 2015 (DE) ..... 20 2015 103 450 U

(51) Int. Cl.

| | |
|---|---|
| ***E04H 17/00*** | (2006.01) |
| ***G08B 13/12*** | (2006.01) |
| ***E04H 17/04*** | (2006.01) |
| ***G08B 13/10*** | (2006.01) |

(52) U.S. Cl.

CPC ..... *E04H 17/003* (2013.01); *E04H 17/04* (2013.01); *G08B 13/122* (2013.01); *G08B 13/10* (2013.01)

(58) Field of Classification Search

CPC ..... E04H 17/003; E04H 17/04; G08B 13/12; G08B 13/122; G08B 13/10; G01L 1/2218; G01L 1/22; G01L 1/2206

See application file for complete search history.

(56) References Cited

U.S. PATENT DOCUMENTS

| | | | | |
|---|---|---|---|---|
| 4,829,287 A | | 5/1989 | Kerr et al. | |
| 5,240,230 A | * | 8/1993 | Dougherty | E04H 17/003 256/24 |
| 5,548,275 A | | 8/1996 | Shambayati et al. | |

(Continued)

FOREIGN PATENT DOCUMENTS

| | | | | |
|---|---|---|---|---|
| EP | 1813741 A2 | | 8/2007 | |
| EP | 2428941 A1 | * | 3/2012 | E04H 17/163 |
| KR | 101420596 A1 | | 7/2014 | |

OTHER PUBLICATIONS

International Search Report dated Nov. 2, 2016, in International Application No. PCT/DE2016/100287.

(Continued)

*Primary Examiner* — Jonathan P Masinick

(74) *Attorney, Agent, or Firm* — Patent Central LLC; Stephan A. Pendorf

(57) ABSTRACT

An anti-climbing device on a fence (7) with angled arms (2) as protective devices having a planar element (1) fastened to the protective device. The planar element is connected to the protective device via force sensors (3). The force sensors are operatively connected to an evaluation unit (4). The force sensors are load cells which predominantly detect loading or load reduction in the direction of gravity. The planar element is fastened along the plane spanned by the arms and the planar element is connected via the force sensors to the arms.

4 Claims, 1 Drawing Sheet

(56) References Cited

U.S. PATENT DOCUMENTS

| | | | | |
|---|---|---|---|---|
| 5,577,712 | A * | 11/1996 | White, Jr. | E04H 17/003 256/2 |
| 6,199,831 | B1 * | 3/2001 | Patrick | A01K 3/00 256/11 |
| 6,782,624 | B2 * | 8/2004 | Marsh | E01F 13/12 256/11 |
| 7,866,635 | B2 * | 1/2011 | Payne | E04H 17/161 256/24 |
| 2011/0252894 | A1 * | 10/2011 | Jung | E04H 17/003 73/862.325 |
| 2013/0062584 | A1 * | 3/2013 | Edmondson | E04H 17/003 256/2 |

OTHER PUBLICATIONS

N.N "Vaku-FenZS" Jan. 29, 2014 (Jan. 24, 2014), pp. 1-4, XP055312807, Retrieved from the Internet: URL:http://www.zaun-sicherheit.de/produkte/information_vaku-fenzs.pdf [retrieved on Oct. 20, 2016] cited in the application p. 2-p. 4.

* cited by examiner

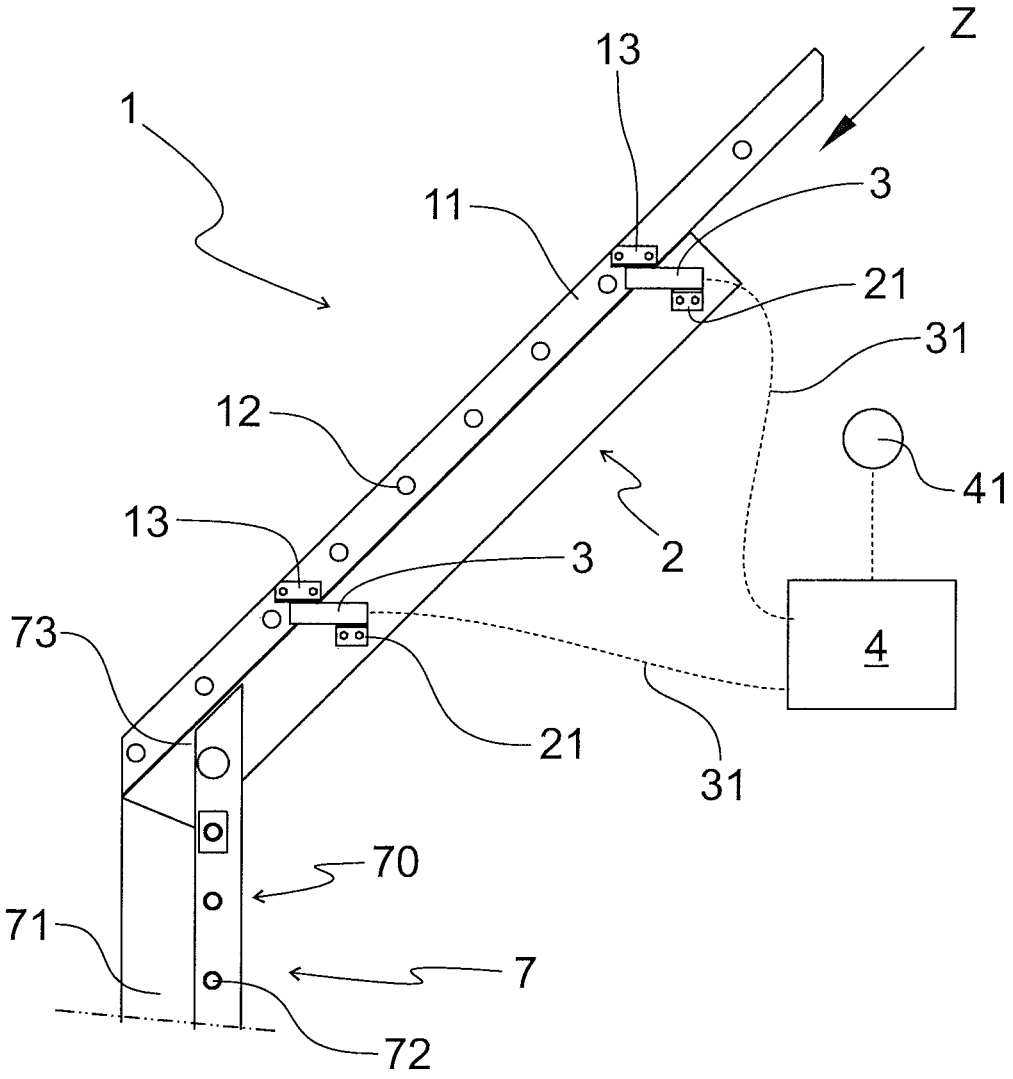
Z
13
1
3
11
21
31
12
41
13
3
2
73
4
21
31
70
71
7
72

ANTI-CLIMBING DEVICE

BACKGROUND OF THE INVENTION

Field of the Invention

The invention relates to an anti-climbing device on a fence.

Description of the Related Art

The need or the legal requirement for technical protection devices (detection devices) at property boundaries, e.g. at fences, has been increasing in recent years. Here, it is necessary to detect that this boundary has been breeched by unauthorized persons. It should be assumed that these unauthorized persons use mechanical, hydraulic or thermal auxiliary tools and climbing aids to overcome this technical protection device. Furthermore, there is a need for a high detection reliability in combination with a low rate of false alarms or undesired messages during the year in all weather conditions. Undesired messages can be generated not only by the effects of weather but also by objects that have been erroneously recognized by the technical protective device as intrusion by a person. In addition, there is a requirement that intruding persons or persons who are in the vicinity of the detection device cannot detect whether a detection system is present, or which functional principle is involved.

BRIEF SUMMARY OF THE INVENTION

As a solution for the technical protective devices on the fence, microphone cable systems, for example, based on piezo, possibly supported by IR- or tensioned-wire device as barrier anti-climb-over device. Reference should be made in this connection to developments based on fiber optic detection systems. Mention may be made, in addition to point-like (acceleration-) detection systems, of modern tension wire systems through which fence defenses, such as razor wires, can be used as "microphone cable systems". Partly also increasingly optical systems such as thermal imaging cameras, video cameras or laser scanners are used, which respond to changes in the image content. Furthermore, photo-sensors or light barriers (one-way, reflection principle or fiber optics also as a curtain) can be used. In this case, a transmitted electromagnetic wave is monitored for interruption (light barrier) or for its time behavior (phase position measurement or laser triangulation of light, usually laser scanner).

The parameterization of such systems to the detection of an invading body or the creation of an opening in the size of a traversable opening according to DIN or VDS guidelines leads, as described in the other systems, to a large number of unwanted messages. Through these systems, in addition to environmental influences such as rain, snow, dust, fog and in part movable objects (same size, smaller or larger than a traversable opening) such as small animals such as birds, hares, foxes or inadvertently persons in the vicinity of the detection device are falsely detected as an intrusion attempt.

For the detection of attempts to climb over, or intrusion on a planar surface, so-called ground-detection systems are used. These consist of pressure sensitive systems such as hoses, mats or cables. Pressure-sensitive sensor hoses are generally laid in the ground at a depth of 25 to 50 cm and at a spacing of about 100 to 150 cm. Each passing-over of these hoses creates a pressure change that is detected and reported by electronic components.

Another variant is a ground detection system in the form of a linear, seismic, passive system, which detects the ground vibrations caused by entering the area to be monitored via temperature-resistant, liquid-filled detection hoses. Thus, the scope is severely limited by the local soil conditions. Detection can not be guaranteed, for example, with ground frost. These systems can be defeated in principle by a wide distribution of weight, for example using a base plate. In order to detect attempts at overcoming the system, the system would have to be adjusted to high sensitively. This would result in a greatly increased false alarm rate, for example, triggered by small animals. Other influencing factors may be snow loads, adjacent vehicle traffic and other seismic effects.

These systems have the further disadvantage that the hoses laid in the ground must be corrosion-resistant and resistant to any ambient chemicals and organic substances. In general, such systems are maintenance-intensive. By their structure, the installation costs and the subsequent maintenance, repair or maintenance costs are high.

Furthermore, a climb-over protection is known, which is provided for example, on fences or walls. It is comprised of two planar elements, which are usually mounted on inclined arms. The planar elements are made for example from metal grids (double wire panels) or wire cables stretched from arm to arm, partly designed as barbed wire. In part such planar elements, in particular in the form of stretched wire cables, are arranged in the top edge of the fence, to form a climb-over protection there.

The planar elements attached to the respective protective device (fence, or wall) have in common that they are intended to prevent a simple climb-over of the protection device, in any case to complicate it. In addition, there are designs in which the stretched signaling cables are designed to trigger an alarm. Signaling cables based on signaling wires are mounted bare or encased on the fence arms. Such systems are easy to manipulate. Freely accessible alarm wires can be bridged-over. Encased or bare alarm wires, however, only recognize a severing. A climbing-over or bending is thus generally possible without detection.

Signaling cables that detect on the basis of field changes are triggered to false alarms due to environmental influences and small animals. Signal cables based on optical fibers are caused to malfunction due to the triggering principle (bending) being influenced by the environment or small animals.

Signaling cables based on sound detectors detect sound emissions. The sound emissions can in turn be generated by environmental influences or small animals. Fence sway, for example, due to wind, can also lead to an unwanted alarm message.

Furthermore, embodiments are known in which photoelectric sensors, laser scanners or imaging surveillance cameras can be used to detect a breeching of the climb-over protection. Photocells and laser scanners are optical detection devices. These can be used as a one-way, reflection principle or fiber optics as a curtain. In this case, a transmitted electromagnetic wave is monitored for interruption (light barrier) or for its time behavior (phase position measurement or laser triangulation of light, usually laser scanner). Imaging surveillance cameras or thermal imaging cameras are optical systems that respond to changes in image content.

Both methods are only of limited suitability, outdoors, since especially with environmental influences such as rain, snow, congestion, fog or in part movable objects such as small animals are to be expected as a source of false alarms. Another disadvantage of these systems is the ease of manipulation by unauthorized persons by redirection, bypassing, absorption or reflection. The manipulation is facilitated by the direct access and obvious recognition of the physical detection principle.

Another system for detecting attempts at circumvention of fence extension arms is a system which detects the buckling of the fence arm itself. For this purpose, a corresponding buckling element is used, which supports the fence arm. This buckling element serves as a "predetermined breaking point" and usually yields non-destructively with application of appropriate weight. Sensors are attached to the buckling element. Considering this mechanical breaking point, sabotage attempts can be easily made by supporting this buckling element, for example, by a wooden slat, ladder, pipe cover, screwing, gluing or sheathing. Furthermore, when triggered, the element must again be returned to the correct starting position mechanically, usually by hand. The tripping criteria are determined by the mechanics of the buckling element and can not simply be "parameterized". Such a detection principle is marketed under the brand name "Vaku-FenZS-Zaunmeldesysteme" by Zaun und Sicherheit GmbH, 97828 Marktheidenfeld, Germany.

Based on this prior art, which encompasses a climb-over protection with detection capability, it is an object of the invention to provide a reliable means for detection of a climb-over attempt by an unauthorized person without the device during normal use triggering a variety of false alarms.

This object is achieved with a climb-over protection according to claim 1.

By virtue of the fact that the force sensors are load cells which primarily detect loads or load reduction in the direction of gravity, wherein the planar element is fastened along the plane spanned by the arms and the planar element is connected to the arms via the force sensors, it is achieved that an additional load (or load reduction) on the planar element is immediately determined by the evaluation unit and an alarm is triggered. Therein the orientation of the force sensors and the design of the system can distinguish different loads, for example, wind-induced loads can be separated from loads by a person weighing on the climb-over protection and thus false alarms can be avoided. The force sensors are commercially available load cells for platform scales or the like, which have at least one strain gauge on their body, which reliably indicates strain or voltage changes on the component in a measurement signal. The load cells detect both strains, as well as reductions, in at least one spatial direction.

In a fence with angled arms, the planar element is fastened along the plane spanned by the arms, wherein the planar element is connected to the arms via the force sensors. Therewith the orientation of the force sensors is selected so that loads or load reductions are primarily measured in the direction of gravity. This prevents laterally attacking wind loads from causing false alarms.

When the planar element is fixed between two consecutive arms, wherein two force sensors are provided on each arm, each area element can reliably detect attempts at climbing over by means of four force sensors or load cells attached to a corresponding fence. For example, each load cell can be set to a measurement threshold of 10 kg so that an alarm signal is triggered only when this load is reached. This avoids that birds settling on the planar element, attacking wind loads, debris in the air, such as plastic films or paper webs, or snow loads lead to false alarms. The planar element is preferably a fence element in the form of a double bar mat or of tensioned (barbed-) wires.

Particularly preferably the planar element is made of profiles so that any weight force acting on the planar element can be passed directly to the sensors arranged on the arms and these can reliably detect the load. Further, such profiles may include an increased resistance to cutting or other manipulations. It is further preferred that the planar element is itself protected against cutting with signaling devices.

If the evaluation unit includes a load threshold above which an alarm is triggered, false alarms due to low loads (or unloadings) can be avoided.

In an alternative or supplementary embodiment, the evaluation unit stores the preceding measured values and compares them with the subsequent ones, wherein a maximum change in measured value is predetermined, above which an alarm is triggered. This makes it possible to exclude slowly increasing loads, for example when a snow load builds up on a planar element, from the events to be detected. Thus, only a certain rate of change is permitted, with too-rapid changes leading to triggering of an alarm.

BRIEF DESCRIPTION OF THE SEVERAL VIEWS OF THE DRAWINGS

The following is an illustrative example of the invention is described in detail with reference to the accompanying FIGURE.

It shows:

FIG. 1 a climb-over protection on a fence.

DETAILED DESCRIPTION OF THE INVENTION

In FIG. 1 the upper part of a fence 7 is shown in side view. The fence 7 has posts 71 anchored vertically in the ground along the boundary to be protected by the fence 7, wherein fence mesh 70 is attached between adjacent posts 71. In FIG. 1 just the top of the post 71 with his head end 73 is shown. The fence 7 can have a fence mesh 70 with tubular elongated elements 72, in which, for example, an optical detection system according to the not yet published utility model application DE 20 2014 103 386.6 is arranged.

At the head end 73 of the fence 7 an arm 2 is fixed so that its free end is pointed diagonally upwards approximately at an angle of 45° to the vertical inside of the fence post 71. An arm 2 is attached at every post 71 so that between two adjacent posts 71 standing side by side with the associated outriggers 2,2 a planar element 1 is attached between two consecutive arms 2,2.

Here the planar element 1 is comprised of a section, like the fence mesh 70 of the fence 7. In a preferred embodiment, this planar element 1 thus also has tubular elongate elements 12, which for the distance between two adjacently arms 2,2 span over the distance between two edge profiles 11. The edge profile 11 is aligned parallel but slightly spaced from the arm 2, wherein two load cells functioning as force sensors 3 are provided for the attachment of the respective edge profile 11 on the arm 2. For mechanical connection angle brackets 21 are provided on the arm 2, and corresponding angle brackets 13 are provided as well on the edge profile 11. It is important that the planar element 1 as a climb-over protection device of the fence 7 is arranged slightly spaced from the arms 2.

In the event of a load on the planar element 1, the load cells 3 arranged between the planar element 1 and the arm 2 measure a corresponding load change Z, which then via an evaluation unit 4, with which the load cells 3 are connected via operating connections 31, on exceeding a predetermined load threshold value, trigger an alarm via alarm device 41.

In addition to the sensors specified here for a possible load on the planar elements 1, suitable detection sensors can be provided on the planar element 1 and in particular on the tubular or z-shaped, elongate elements 12 in order to detect tampering with the respective structure, report and to trigger the alarm. Of course, any force sensors can be used that can detect an excessive load on the respective planar elements 1 at the corresponding installation location. Preferred are load cells 3 with strain gauges. It should also be noted that the load cells 3 are arranged on the side away from the attack. Therewith, attempts at manipulation made directly on the load cells 3 are prevented.

If preselected suitable load thresholds are stored in the evaluation unit 4, then significantly lower loads, such as wind-induced stress or birds sitting on the planar element, etc. do not to trigger an alarm. Alternatively or additionally, it is possible that the evaluation unit 4 also continuously or recurrently measures the respective preceding load values and stores and compares them with each other. In this case, a slowly changing load signal can be defined as permissible, while a stronger change in measured value (larger gradient) triggers the alarm. This can be used to disregard slow-building loads, such as snow loads.

LIST OF REFERENCE NUMBERS

1 planar element
11 edge profile
12 tubular, elongated element
13 second angle bracket
2 arm
21 first angle bracket
3 force sensor, load cell
31 operative connection
4 evaluation unit
41 alarm device
7 fence
70 fence mesh
71 post
72 elongated element, tube
73 head end
Z load change

The invention claimed is:

1. A climb-over protection device on a fence (7) with angled arms (2), the climb-over protection device including a planar element (1), wherein the planar element (1) is connected to two successive angled arms (2) via force sensors (3), the force sensors (3) are operatively connected with an evaluation unit (4), the force sensors (3) are load cells, which detect primarily loading or load reduction in the direction of the force of gravity, the planar element (1) is oriented parallel to a plane spanned by the angled arms (2), the planar element (1) is formed from two edge profiles (11) and tubular, elongate elements (12) which extend over the distance between the two edge profiles (11) and are oriented adjacent to each other between the two edge profiles (11), and each of the two edge profiles (11) lies on an associated cantilever arm (2) parallel but slightly spaced apart relative to the associated cantilever arm (2), and in each case two force sensors (3) designed as load cells are provided for fastening of the respective edge profile (11) to the associated cantilever arm (2).

2. The climb-over protection device according to claim 1, wherein the evaluation unit (4) includes a load threshold value, above which an alarm is triggered.

3. The climb-over protection device according to claim 1, wherein the evaluation unit (4) stores previous readings and compares them to subsequent readings, wherein a maximum change in readings is predetermined, above which an alarm is triggered.

4. The climb-over protection device according to claim 1, wherein the evaluation unit (4) stores previous readings and compares them to subsequent readings, wherein a maximum rate of change in readings is predetermined, above which an alarm is triggered.

* * * * *